US007295791B2

(12) United States Patent
Aiba

(10) Patent No.: US 7,295,791 B2
(45) **Date of Patent: *Nov. 13, 2007**

(54) DISCHARGE METHOD FOR ELECTROPHOTOGRAPHIC PROCESS UNIT DETACHABLE FROM IMAGING APPARATUS AND IMAGE FORMING APPARATUS THEREOF

(75) Inventor: Hidemasa Aiba, Kokuroda-cho (JP)

(73) Assignee: Kyocera Mita Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/554,167

(22) Filed: Oct. 30, 2006

(65) Prior Publication Data

US 2007/0147873 A1 Jun. 28, 2007

Related U.S. Application Data

(63) Continuation of application No. 11/230,306, filed on Sep. 19, 2005, now Pat. No. 7,149,452, which is a continuation of application No. 10/832,453, filed on Apr. 27, 2004, now Pat. No. 7,035,566.

(30) Foreign Application Priority Data

Apr. 28, 2003 (JP) ..... 2003-123467

(51) Int. Cl.
*G03G 15/00* (2006.01)
*G03G 21/18* (2006.01)

(52) U.S. Cl. ..... 399/90; 399/111; 399/116

(58) Field of Classification Search ..... 399/90, 399/111, 116

See application file for complete search history.

(56) References Cited

U.S. PATENT DOCUMENTS 5,528,342 A 6/1996 Setoriyama
5,537,189 A 7/1996 Imes
5,581,325 A 12/1996 Tsuda et al.
5,854,955 A 12/1998 Yawata et al.
5,893,657 A 4/1999 Matsuzawa
5,907,751 A 5/1999 Kawaguchi et al.
5,930,560 A 7/1999 Sawaki
5,966,568 A 10/1999 Numagami et al.
6,029,019 A 2/2000 Kawai
6,178,300 B1 1/2001 Lee et al.
6,272,299 B1 8/2001 Numagami et al.
6,408,151 B1 6/2002 Heno
6,473,581 B1 10/2002 Sugiyama
6,810,221 B1 10/2004 Meyer et al.
7,035,566 B2 4/2006 Aiba (Continued)

FOREIGN PATENT DOCUMENTS

JP 9-090690 A 4/1997

*Primary Examiner*—William J. Royer

(57) ABSTRACT

When a sheet jams in an image forming machine with a detachable unit having at least an image carrier device, it is necessary to detach the unit to remove the sheet when the image carrier device is charged with electric charge. When the unit is detached and re-attached, spark discharging may occur inducing noise upon a contact of an electrically conductive shaft of the image carrier device to a ground conductor. The present invention prevents the occurrence of such a problem by making the unit pass near a charge eliminating member, when the unit is detached from the image forming machine, extracting the unit to an outside of the machine, and making the unit pass near the charge eliminating member, when the unit is attached in machine.

17 Claims, 11 Drawing Sheets

U.S. PATENT DOCUMENTS 7,149,452 B2 * 12/2006 Aiba ..... 399/90
2004/0213596 A1 10/2004 Meyer et al.
2004/0218944 A1 11/2004 Kawaguchi et al.

* cited by examiner

DISCHARGE METHOD FOR ELECTROPHOTOGRAPHIC PROCESS UNIT DETACHABLE FROM IMAGING APPARATUS AND IMAGE FORMING APPARATUS THEREOF

CROSS-REFERENCE TO RELATED APPLICATIONS

The present application is a Continuation of, and claims priority from, U.S. patent application Ser. No. 11/230,306 entitled "Discharge Method for Electrophotographic Process Unit Detachable From Imaging Apparatus and Image Forming Apparatus Thereof" filed Sep. 19, 2005, now U.S. Pat. No. 7,149,452 which in turn is a Continuation of, and claims priority from, U.S. patent application Ser. No. 10/832,453 entitled "Image Forming Apparatus" filed on Apr. 27, 2004 now issued as U.S. Pat. No. 7,035,566 B2, the contents of each of which are incorporated herein by reference.

BACKGROUND OF THE INVENTION

The present invention is related to an image forming machine such as a copying machine, printer, facsimile machine, and combined machine of them using an electrophotographic process, specifically to an image forming machine composed such that a unit integrating at least an electric charging device and an image carrier device is detachably mounted or only an image carrier device is detachably mounted and a mechanism is provided for removing the electric charge accumulated in the process of detaching or attaching the unit from or to the image forming machine.

In the field of image forming machines such as copying machines, printers, facsimile machines, and combined machines aimed for personal use, a unit integrating at least an electric charging device and an image carrier device and mounted detachably to a body of the image forming machine is used to ease the handling of the machine by making it possible for users to perform the maintenance of the machine.

However, in the image forming machine in which the unit like this or only the image carrier device (photoreceptor) is detachable, when a sheet is jammed during image formation in the state the sheet is nipped between a photoreceptor drum and transfer roller due to the occurrence of malfunction in a clutch, inadequate feeding of a copy sheet due to the skew of the sheet, slipping of the sheet, etc., can occur while the image carrier device is still charged as the charging device for charging the image carrier device had been working until just before the jam. If the user detaches the unit or image carrier device from the image forming machine body to remove the jammed paper sheet and again sets the unit or image carrier device to the machine body after the jammed sheet is removed, spark discharge occurs and noise is produced when an electrically conductive shaft of the image carrier device contacts with a grounding member provided to the image forming machine body. Actually a phenomenon occurs in which the machine's initialization program falls into an endless loop and printing becomes impossible when electrical discharging occurs while the initialization program for initializing the image forming machine was working.

A similar phenomenon will happen in an image forming machine, in which a casing of the machine is configured such that an outer part thereof is capable of opening and closing, when a safety measure function works by intentionally opening an outer part of the casing, and electric power supply to apply high d.c. voltage to a motor, clutch, charger of the drum, etc., is shut down. That is, if electrical discharging like this occurs, a noise signal induced by the discharging directly enters a lead wire strung around the inside of the image forming machine or a circuit of a main board and interferes with the execution of an initialization program in a CPU, and a ready signal which is to be sent forth when the initialization program works normally is not sent out. Such a phenomenon tends to occur in the case resin material is used in many of the component parts and electrostatic guard is not sufficient.

As to a method for eliminating electric charge on the unit or image carrier device, an image forming machine is disclosed for example in Japanese Laid-Open Patent Application No. 9-90690 (hereafter referred to patent literature 1) which is composed such that, before a process cartridge reaches the required position, a photoreceptor drum or developing sleeve of a developing device is allowed to contact an electrode provided in the image forming machine to let a static charge go off to a machine body or the photoreceptor drum and developing sleeve are together grounded in order to equalize an electric potential of them with that of the machine body. By composition, a charged memory, which is induced due to the phenomenon that the photoreceptor drum or developing sleeve becomes charged by a static charge caused by any reason and electric discharging occurs between the photoreceptor drum and an electrically conductive member located adjacent to the photoreceptor drum when replacing the photoreceptor drum unit or other unit, is prevented from being produced in the photoreceptor drum.

However, the image forming machine disclosed in patent literature 1 is of the composition for preventing a charged memory, which is induced due to the phenomenon that the photoreceptor drum or developing sleeve becomes charged by the static charge caused by any reason and electric discharging occurs between the photoreceptor drum and the electrical conductive member located adjacent to the photoreceptor drum, from being produced in the photoreceptor drum, and therefore, although the buildup of the charged memory can be prevented, the noise accompanying the discharging is not taken into consideration. Therefore, the phenomenon that the initialization program falls into an endless loop cannot be prevented.

Accordingly, the object of the present invention is to provide an image forming machine composed such that the unit or image carrier device (photoreceptor) is detachably mounted to the machine, wherein even when the unit or image carrier device (photoreceptor) is detached for removing a jammed copy sheet and again attached in the state the image carrier device (photoreceptor) is charged, the influence caused by the noise due to electrical discharging can be suppressed.

SUMMARY OF THE INVENTION

To attain the object, the present invention proposes an image forming machine with a unit having at least an image carrier device for forming a toner image by an electrophotographic method mounted detachably thereto, the image carrier device having an electrical conductive shaft, wherein the image forming machine has guide grooves in the base frames thereof for guiding both end parts of the electrically conductive shaft of the image carrier device in order to position the unit in place, the image forming machine has guide grooves in the base frames thereof for guiding both end parts of the electrically conductive shaft of the image carrier device in order to position the unit in place, a contact member is provided at a position where the conductive shaft of the unit comes into contact with the contact member when the unit is positioned in place, and a charge eliminating member for eliminating the electric charge accumulated on the image carrier device by way of the conductive shaft is provided at a position upstream from said position.

By providing the charge eliminating member which allows the electric charge accumulated on the image carrier device in an image forming machine to be discharged when the unit having at least the image carrier device, the charge accumulated on the image carrier device is eliminated by the electrical discharging between the conductive shaft of the image carrier shaft and the charge eliminating member at least two times, i.e., when detaching and attaching the unit, and the amount of remaining charge is decreased by the discharging. Therefore, even if discharge occurs by chance between the conductive shaft of the image carrier device and the contact member when detaching and then attaching the unit to be positioned in place (in the position where the conductive shaft of the image carrier device is positioned in the guide groove when image formation is carried out), the noise due to the discharge is very weak. Accordingly, when the copy sheet is jammed in the process of image formation and the unit is detached to remove the jammed sheet in the state the image carrier device is charged with electric charge, the occurrence that the execution of the initializing program in the CPU of the controller is interfered by the noise signal caused by electric discharge induced by the contact of the conductive shaft with the contact member can be prevented.

By composing the charge eliminating member as a charge eliminating brush by bundling electrically conductive thin strings or threads of volume specific resistance of 1~0.01 Ω·cm, it is possible to effectively eliminate the electric charge remaining on the image carrier device by discharging.

Further, by locating the charge eliminating member so that there is a certain clearance, for example 1~2 mm, between the tip of the bundled conductive thin strings or threads and the conductive shaft when the conductive shaft passes by the charge eliminating member in one of the guide grooves, the occurrence are prevented that the bundled conductive thin strings or threads are deranged, bent, or broken and the broken piece or pieces of the thin strings or threads fall in the image forming machine and are conveyed by the cooling air produced by a fan in the machine to the circuit board even if the unit or the image carrier device is detached or attached, for the conductive shaft of the image carrier shaft does not come into contact with the charge eliminating member. As a result, the occurrence of malfunction in the circuit board, etc., is prevented. As the discharging is done by corona-discharging, the discharging can be done even if there is a certain clearance between the tip of charge eliminating member and the conductive shaft, and the occurrence can be prevented that the execution of the initializing program in the CPU of the controller is interfered by the noise signal.

Further, by configuring the charge eliminating member such that its width is larger than the diameter of the conductive shaft and providing the charge eliminating member to a drive plate, to which a drive force transmission mechanism of the machine is mounted, so that the brush faces the end face of the conductive shaft sliding along the guide groove through the guide groove of which the width is equal to or smaller than 10 mm, it is not necessary to prepare a special grounding means, and the cost of the image forming machine is reduced.

Further, it is suitable that the charge eliminating member is a plate member made of metal provided to protrude in the groove so that the conductive shaft contacts the member when the unit is detached/attached by guiding the conductive shaft along the guide grooves.

Still further, the invention provides a method for discharging a detachable process unit, which is detached from an electrophotographic imaging apparatus and includes an image carrier device, that includes making the process unit pass near a charge eliminating member, when the process unit is detached from the electrophotographic imaging apparatus, extracting the process unit to an outside of the electrophotographic imaging apparatus, making the process unit pass near the charge eliminating member, when the process unit is attached in the electrophotographic imaging apparatus, and placing the process unit at a prescribed location.

In a further embodiment, a discharge method for discharging a detachable process unit which is detached from an electrophotographic imaging apparatus and includes an image carrier device includes making the process unit contact a charge eliminating member when the process unit is detached from the electrophotographic imaging apparatus, extracting the process unit to an outside of the electrophotographic imaging apparatus, making the process unit contact the charge eliminating member, when the process unit is attached in the electrophotographic imaging apparatus, and placing the process unit at a prescribed position.

BRIEF DESCRIPTION OF THE DRAWINGS

The invention will be described in greater detail with reference to the preferred embodiments of the invention and the accompanying drawings, wherein:

FIG. 7(A) is a perspective view of the right side and FIG. 7(B) is that of the left side;

DETAILED DESCRIPTION OF THE PREFERRED EMBODIMENTS OF THE INVENTION

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
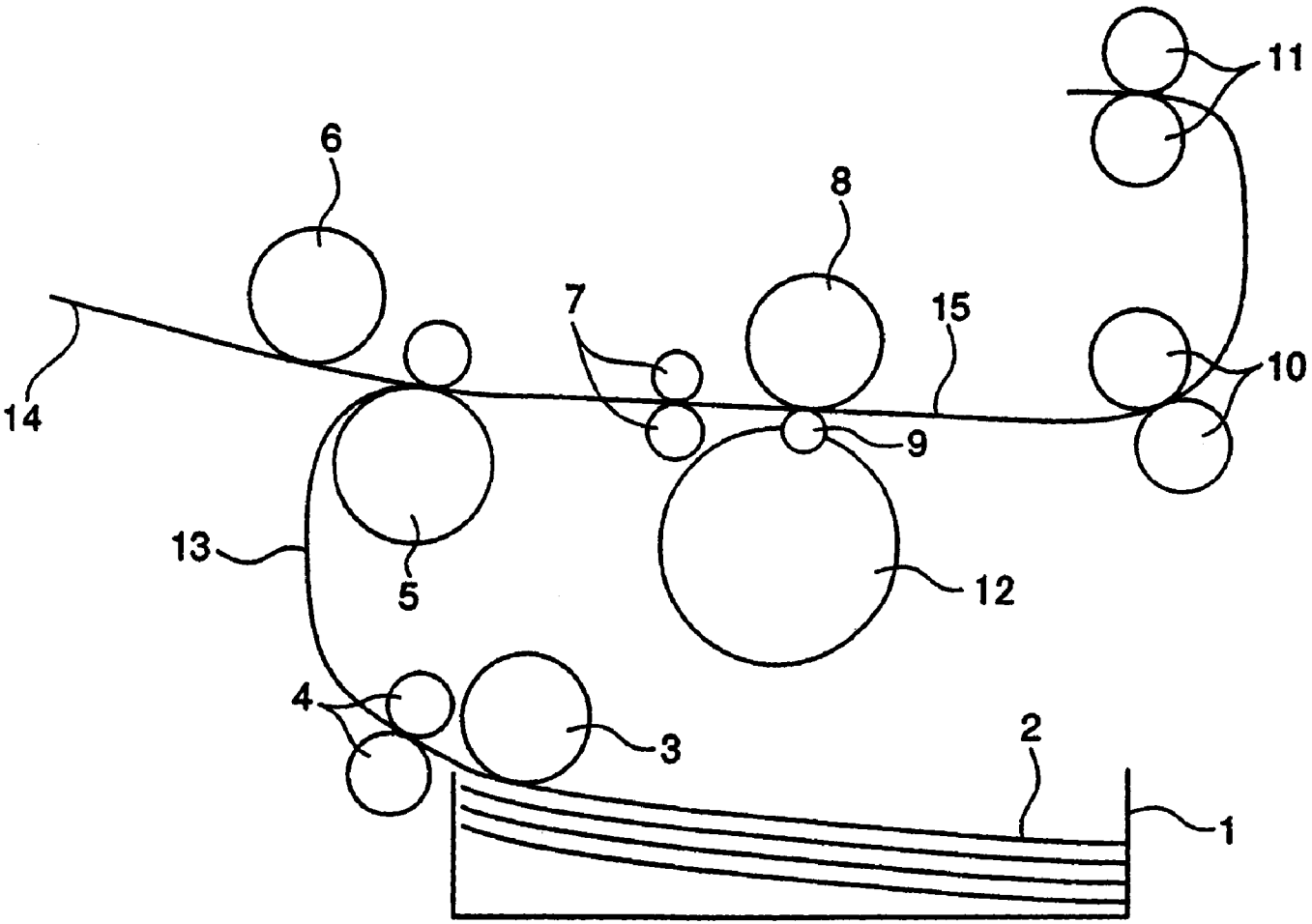
FIG. 1 is a conceptual illustration for explaining the location of major components and transporting path of the copy sheet in the image forming machine according to the present invention.

In the drawings, same reference numerals denote the same components. Referring to FIG. 1, reference numeral 1 is a paper feeder cassette accommodating copy sheets 2, 3 is a pick up roller for picking up and feeding copy sheets 2, 4 is a pair of separating/feeding rollers for positively picking up the copy sheet 2 one by one and send them to a sheet transfer path 13, 5 is a pair of intermediate rollers, 6 is a second feed roller for sending the copy sheet placed on a manually feeding part, 7 is a pair of registration roller for correcting the positioning of the sheet reached there and sending out toward an image transfer position synchronizing with the timing of toner image formation on a photoreceptor 8 (image carrier device). Reference numeral 9 is an image transfer roller, 10 is a pair of fusing rollers, 11 is a pair of ejecting rollers, 12 is a motor for driving the pick up roller 3, intermediate rollers 5, second feed roller 6, registration rollers 7, photoreceptor (image carrier device) 8, fusing rollers 10, ejecting rollers 11, etc. Reference numeral 13 is a sheet transport path from the paper feeder cassette 1, 14 is a manual feed path from the manually feeding part, 15 is a transport path from the intermediate rollers 5 to the ejecting rollers 11. Around the photoreceptor 8 (image carrier device) are disposed a charging device, exposure device, developing device, cleaning blade (cleaning means), etc., not shown in the drawing to compose a process unit, and further, transfer guides and rollers not shown in the drawing are provided between the separating/feeding rollers 4 and intermediate rollers 5, between the intermediate rollers 5 and registration rollers 7, between the photoreceptor 8 and fusing rollers 10, and between the fusing rollers 10 and ejecting rollers 11. The process unit includes not necessarily all of the photoreceptor (image carrier device), charging device, light exposure opening, developing device, cleaning blade, etc., it may be a unit integrated with some of these components including at least the photoreceptor (image carrier device).

Figure 2A:
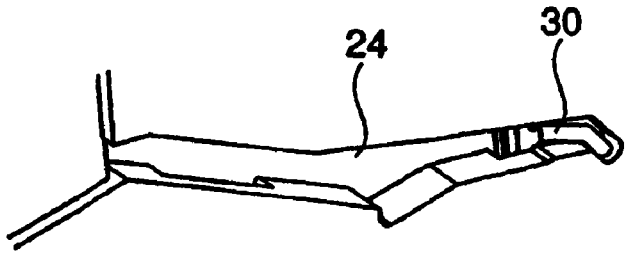
FIG. 2(A) is a perspective view showing the left side guide groove for guiding the unit having at least the image carrier device of the image forming machine according to the present invention.
Figure 2B:
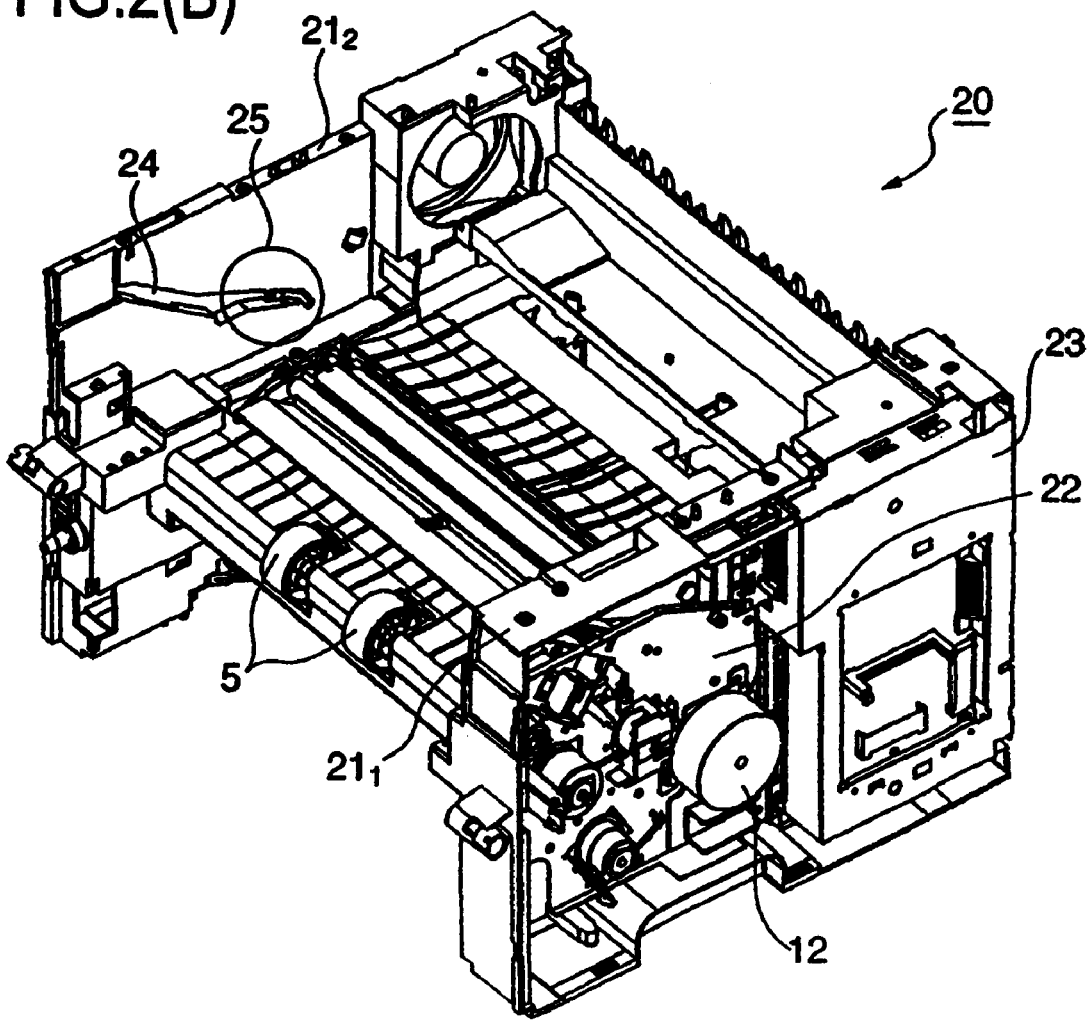
FIG. 2(B) is a perspective view of the image forming machine with the outer cover thereof removed.
Figure 3A:
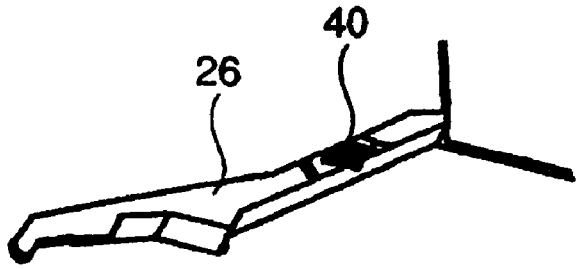
FIG. 3(A) is a perspective view of the right side guide groove for guiding the unit having at least the image carrier device of the image forming machine according to the present invention of the present invention.
Figure 3B:
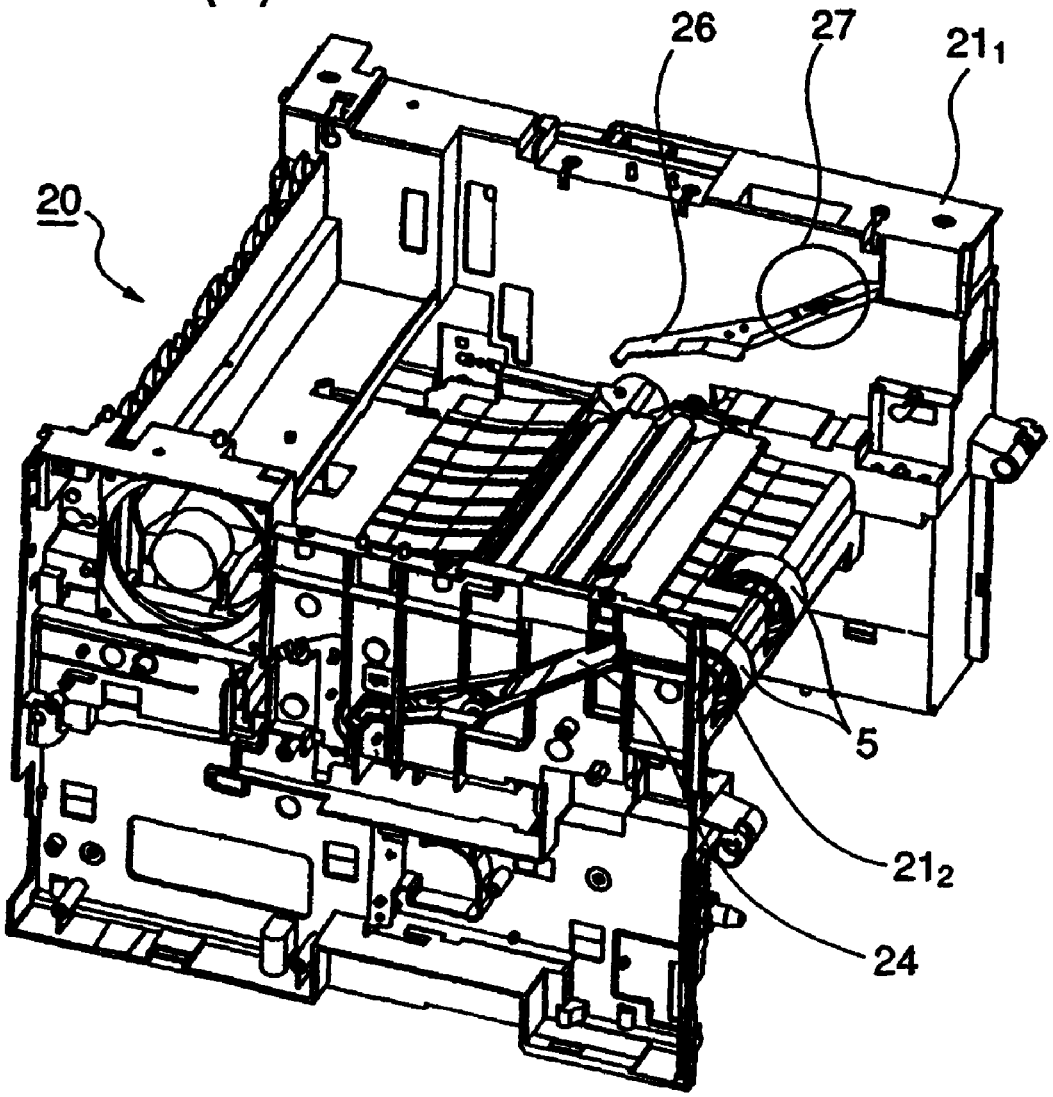
FIG. 3(B) is a perspective view of the image forming machine with the outer cover thereof removed.

Referring to FIG. 2(B) and FIG. 3(B), reference numeral 20 is the main body of the image forming machine with its outer cover removed, and each of $\mathbf{21}_1$ and $\mathbf{21}_2$ is a base frame of the main body 20, each of guide grooves 24, 26 being provided respectively to each of the base frames $\mathbf{21}_1$ and $\mathbf{21}_2$ to guide the process unit. Reference numeral 22 is a drive plate mounted with a driving force transmission mechanism and a motor, etc., 23 is a control box. The guide grooves 24, 26 provided to the base frames $\mathbf{21}_1$ and $\mathbf{21}_2$ guide the shaft of the image carrier device (photoreceptor) 8. Reference numeral 25 indicates the position in the guide groove 24 where the process unit is set, the guide groove 24 being shown enlarged in FIG. 2(A). Reference numeral 27 indicates the position where a charge eliminating brush 40 as a charge eliminating member is present in the guide groove 26, the guide groove 26 being shown enlarged in FIG. 3(A). Reference 30 is a ground plate as a contact member made of a leaf spring to be contacted with the electrically conductive shaft of the image carrier device 8 when the process unit is positioned in place. The conductive shaft not shown in the drawing is connected with the base metal of the image carrying substrate in the image carrier device 8.

In FIG. 3~FIG. 6, reference numeral 40 is the charge eliminating brush as a charge eliminating member of the first embodiment for allowing the electric charge accumulated on the image carrier device 8 in the image forming machine of the present invention to be corona-discharged, 41 is a brush holder, 42 are brush ears made of conductive thin strings or threads shaped, for example, by extruding the mixture of resin and copper powder. As to the conductive thin string or thread, the one made of polycarbonate thin string or thread coated with copper sulfide, the volume specific resistance of the thin string or thread being 1~0.01 Ω·cm, which is available as the product name of Thunderon produced by TSUCHIYA TSCO COMPANY, Ltd., can be used, and any other products having the same effect may be used. Reference numeral 43 is a gear attached to the shaft of the motor 12, 44 is a gear for driving the process unit. Referring to FIG. 7, reference numeral 60 is an example of a process unit 60 provided with an image carrier device (photoreceptor) 8, charging device 63, developing device 64, cleaning blade (cleaning means), etc.; 61 and 62 are electrically conductive shafts of the image carrier device (photoreceptor) 8, 63 is the charging device, 64 is the developing device, 65 is the drum part of the image carrier device (photoreceptor) 8, 66 is a toner container accommodating toner, and 67 is a recovery section of the toner remained on the surface of the image carrier device (photoreceptor) 8 without transferred to the copy sheet.

Figure 8A:
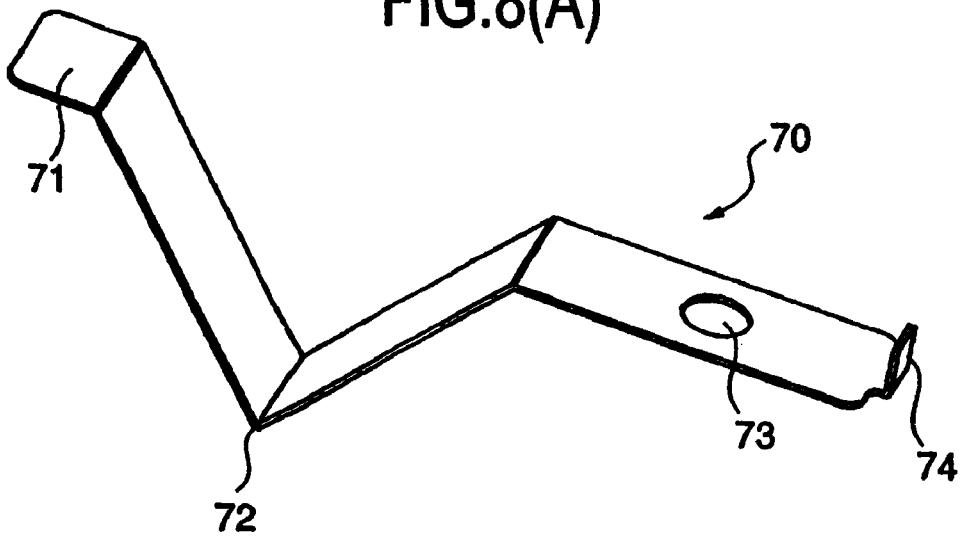
FIG. 8(A) is a perspective view showing the first embodiment of the charge eliminating member attached to the drive plate for allowing the electric charge accumulated on the image carrier device to be discharged.
Figure 8B:
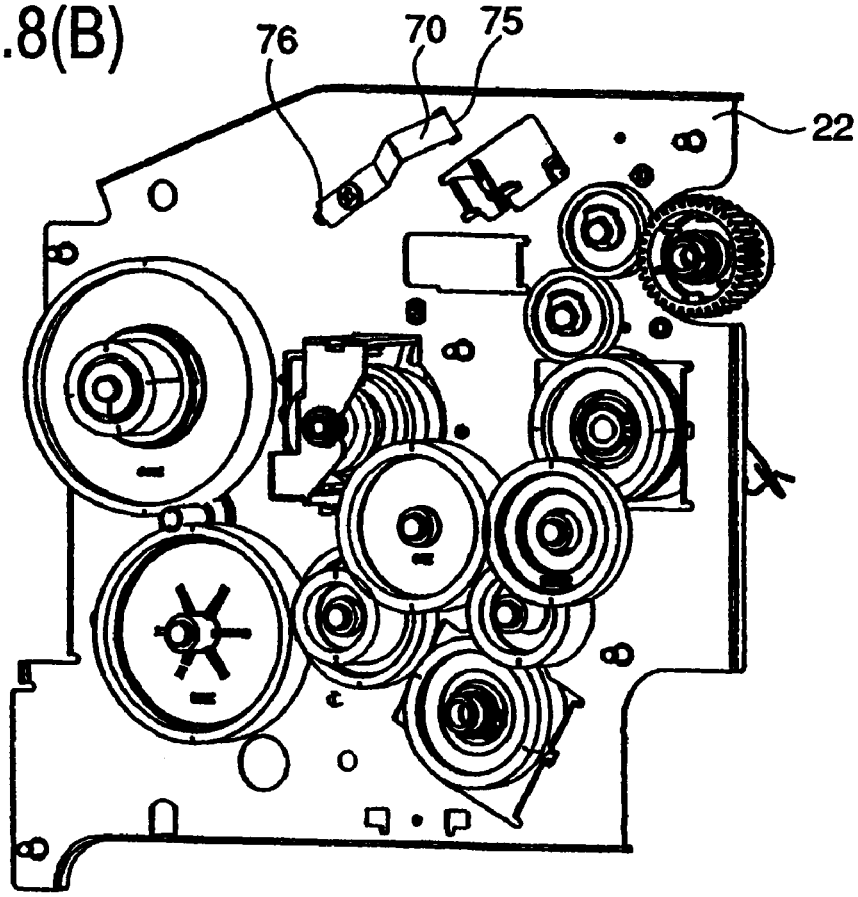
FIG. 8(B) is a perspective view showing the attaching position thereof in the image forming machine according to the present invention.
Figure 10:
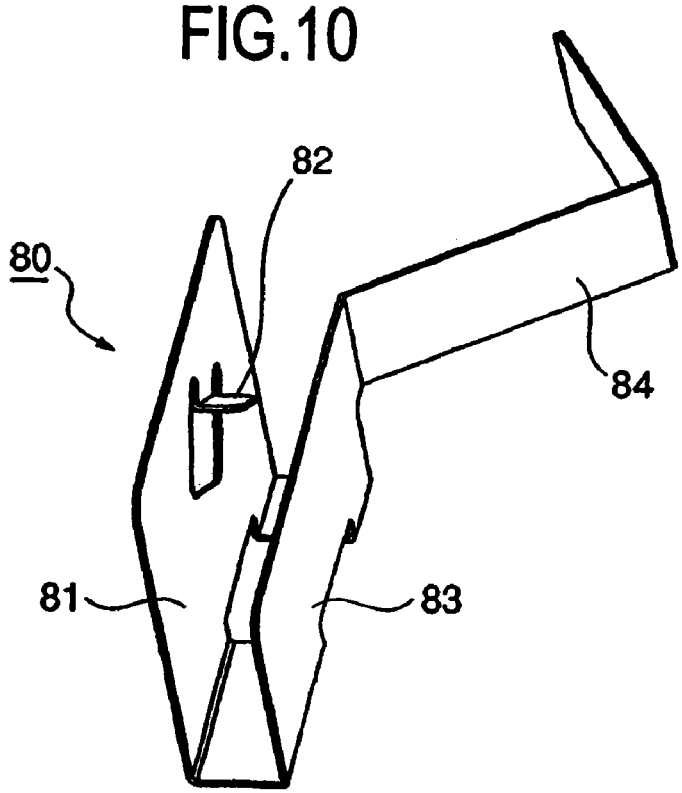
FIG. 10 is a perspective view showing the third embodiment of the charge eliminating member for allowing the electric charge accumulated on the image carrier device to be discharged in the image forming machine according to the present invention.
Figure 11:
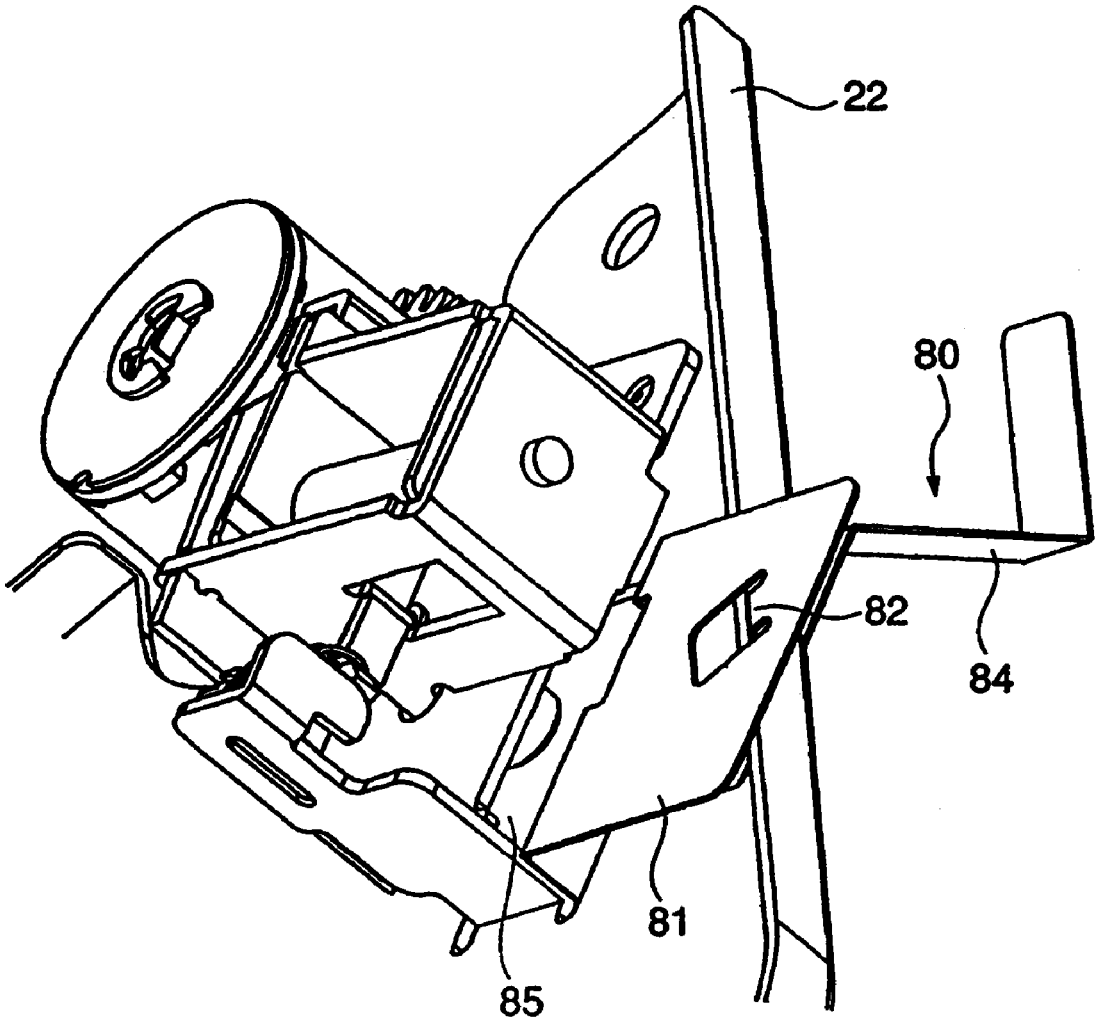
FIG. 11 is a perspective view showing the third embodiment of the charge eliminating member attached to the drive plate for allowing the electric charge accumulated on the image carrier device to be discharged in the image forming machine according to the present invention.
Figure 12A:
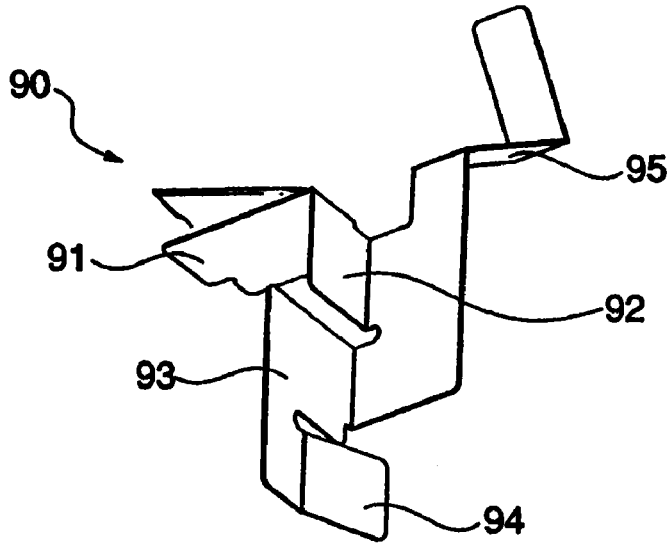
FIG. 12(A) is a perspective view showing the fourth embodiment of the charge eliminating member for allowing the electric charge accumulated on the image carrier device to be discharged.
Figure 12B:
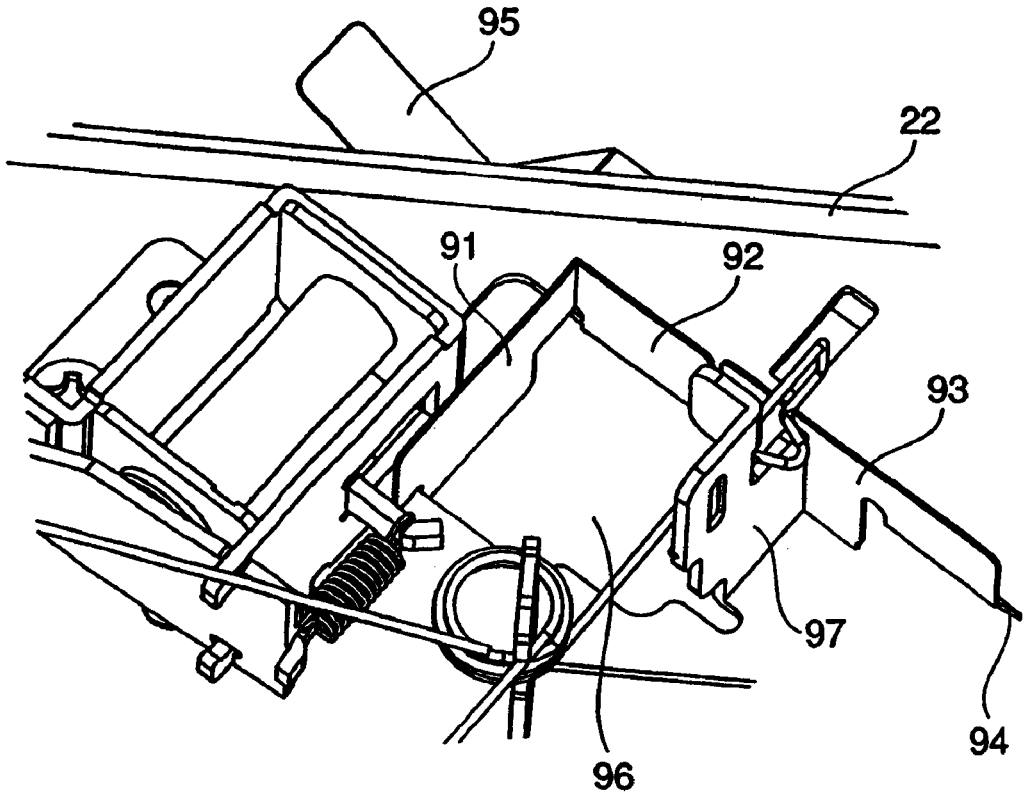
FIG. 12(B) is a perspective view showing the state when the charge eliminating member is attached to the drive plate in the image forming machine according to the present invention.

Referring to FIGS. 8(A) and 8(B), reference numeral 70 is a ground plate as a charge eliminating member of the second embodiment for allowing the electric charge accumulated on the image carrier device (photoreceptor) 8 to be discharged, 71 is the end part, 72 is the crest part, 73 is the hole for a screw (tightening bolt), 74 is the claw part of the ground plate 70, and 75 and 76 are holes or slits for holding the plate provided in the drive plate 22. Referring to FIG. 10, reference numeral 80 is a ground plate as a charge eliminating member of the third embodiment for allowing the electric charge accumulated on the image carrier device (photoreceptor) 8 to be discharged, 81, 83 are side plates, 82 is the protrusion, 84 is the crest part of the ground plate 80. The ground plate 80 is attached to the drive plate 22 as shown in FIG. 11. Referring to FIGS. 12(A) and 12(B), reference numeral 90 is a ground plate as a charge eliminating member of the fourth embodiment for allowing the electric charge accumulated on the image carrier device (photoreceptor) 8 to be discharged, 91, 92, and 93 are the parts of the ground plate 90 by which the ground plate 90 is fixed to the drive plate 22 utilizing an opening 96 and cut-and-erected part 97 provided to the drive plate 22. Reference numeral 94 is the end part of the part 93 and 95 is the crest part of the ground plate 90.

Figure 7A:
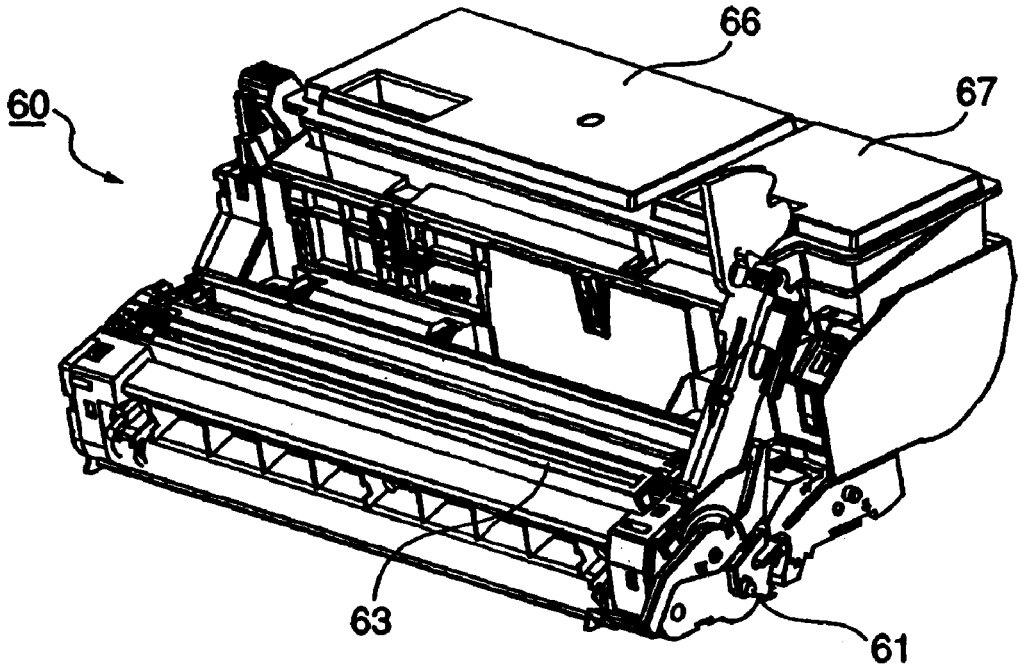
FIGS. 7(A) and 7(B) illustrate examples of the unit having at least the image carrier device of the image forming machine according to the present invention, where
Figure 7B:
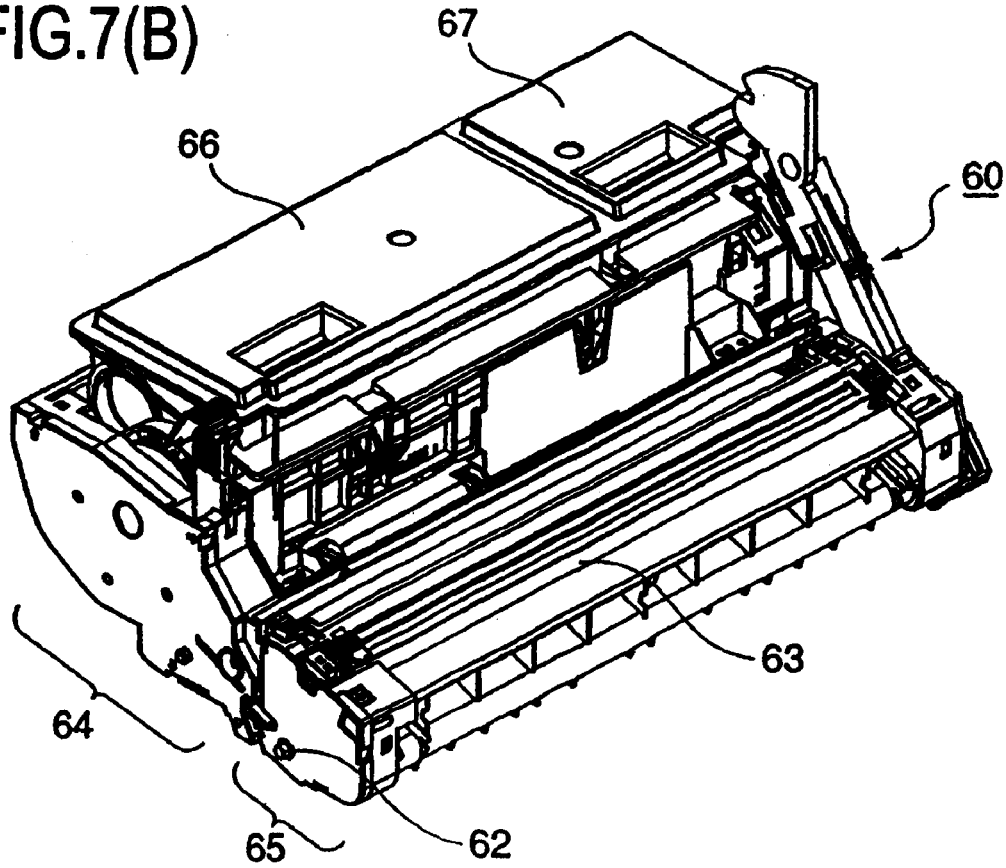

First, a brief explanation of the image forming machine of the invention will be given here. The main body 20 of the image forming machine of the invention is, as shown in FIG. 2(B) and FIG. 3(B), provided on both sides thereof with the base frames $\mathbf{21}_1$ and $\mathbf{21}_2$ for retaining components of various functions. A motor 12, a clutch, etc., are attached to the base frame $\mathbf{21}_1$ as shown in FIG. 2(B). As shown in FIG. 5(B) (FIG. 2(B) is a view from the motor side and FIG. 5(B) is a view from the driving gear train side, both FIGS showing the front and rear side of the drive plate 22 respectively), to the base frame $\mathbf{21}_2$ are attached a drive gear 44 for driving a process unit 60 (see FIGS. 7(A) and 7(B)) which is driven by a gear attached to the shaft of the motor 12, and the drive plate 22 provided with drive gears for driving the mechanism for feeding and transferring the copy sheet as shown in FIG. 5(B). The process unit 60 composed of an image carrier device (photoreceptor) 8, charging device 63, developing device 64, cleaning blade (cleaning means) not shown in the drawing, etc., as shown in FIGS. 7(A) and 7(B), can be mounted in place with the electrically conductive shaft 61, 62 of the image carrier device (photoreceptor) 8 guided by the guide grooves 24, 26 shown in FIGS. 2(A) and 2(B), FIGS. 3(A) and 3(B). When the process unit 60 is positioned in place, the electrically conductive shaft 61 of the image carrier device (photoreceptor) 8 contacts the ground plate (contact member) 30 shown in FIG. 2(A) to ground the image carrier device (photoreceptor) 8.

Figure 4:
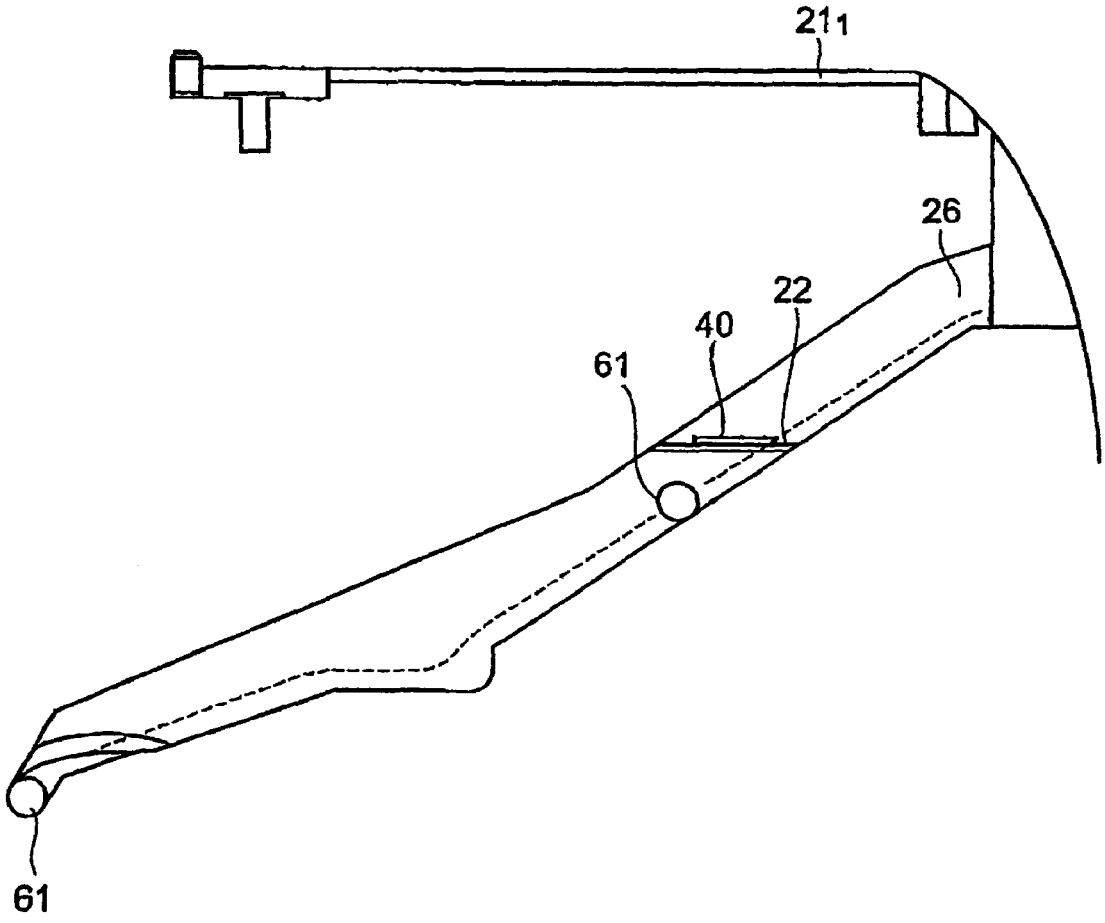
FIG. 4 is a view showing a groove to indicate the position where the first embodiment of the charge eliminating member attached to the drive plate peeps through the groove formed in the base frame in the image forming machine according to the present invention.
Figure 5A:
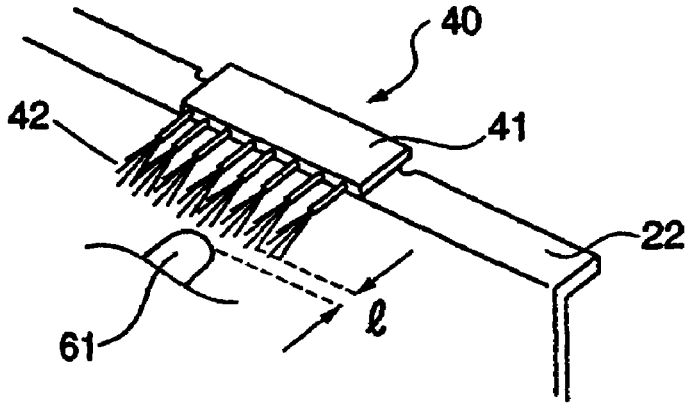
FIG. 5(A) is a perspective view showing the first embodiment of the charge eliminating member attached to the drive plate for allowing the electric charge accumulated on the image carrier device to be corona-discharged.
Figure 5B:
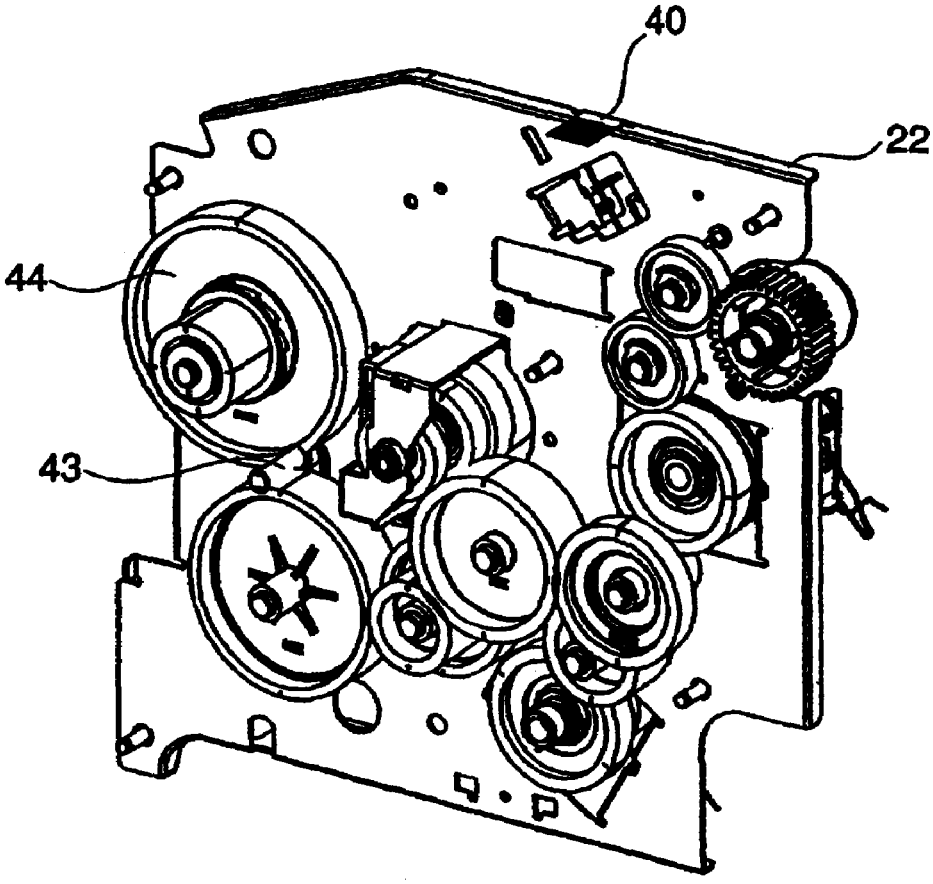
FIG. 5(B) is a perspective view showing the attaching position thereof in the image forming machine according to the present invention.

The charge eliminating brush 40 as a charge eliminating member for corona discharging as shown in FIGS. 5(A) and 5(B), FIGS. 6(A) and 6(B) is affixed to the drive plate 22 at the position shown in FIG. 5(B), for example by a double-faced conductive tape as shown in FIG. 5(A). In order to allow the electric charge accumulated on the image carrier device (photoreceptor) 8 to be discharged (to be corona-discharged in the embodiment) by way of the electrically conductive shaft 61 when the process unit 60 is attached to or detached from the base frame $\mathbf{21}_1$ of the main body 20, the charge eliminating brush 40 formed to be wider in width than the diameter of the conductive shaft 61 is provided so that the tips of the brush ears 42 thereof peeps at the guide groove 26 of which the width is equal to or smaller than 10 mm, as shown in FIG. 3(A) and FIG. 4. More specifically, the brush 40 is attached to the drive plate 22 so that the tips of the ears 42 of the brush 40 face the end face of the conductive shaft 61 through the sloped guide groove 26 of the base frame $\mathbf{21}_1$ in an attitude crossing the guide groove 26 nearly horizontally when the drive plate 22 is attached to or detached from the base frame $\mathbf{21}_1$. When the process unit 60 is detached or attached with the conductive shaft 61 guided along the guide grooves 24, 26 while holding the process unit 60 with hands, the conductive shaft 61 moves up or down along the guide grooves 24, 26 contacting the lower faces of the guide grooves 24, 26 due to its weight of about 4 kg. Therefore, by providing the charge eliminating brush 40 so that the tips of the ears 42 thereof peeps at the guide groove 26 in an attitude crossing the guide groove 26, the conductive shaft 61 positively faces the charge eliminating member 40 with a certain distance retained between the conductive shaft 61 and the charge eliminating member 40 in the course of detaching or attaching the process unit 60 and electric discharging occurs between them.

Figure 6A:
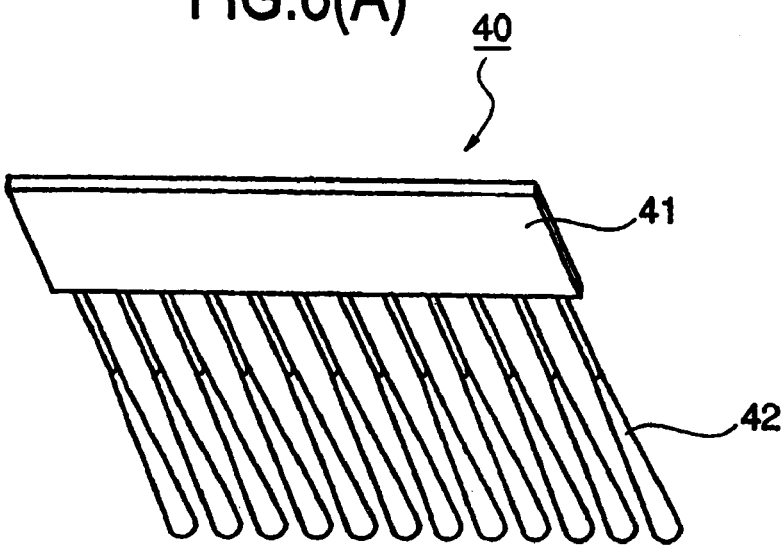
FIGS. 6(A) and 6(B) are enlarged details of the first embodiment of the charge eliminating member for allowing the electric charge accumulated on the image carrier device to be corona-discharged in the image forming machine according to the present invention.
Figure 6B:
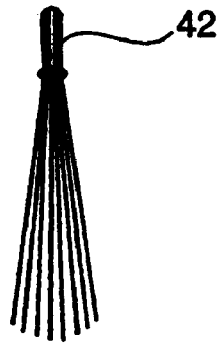

The charge eliminating brush 40 is composed, for example as shown in FIGS. 6(A) and 6(B), such that the ears 42 of the brush 40, each ear having a bundle of conductive thin strings or threads made of polycarbonate thin string or thread coated with copper sulfide, the volume specific resistance of the thin string or thread being 1~0.01 Ω·cm, the thin string or thread being available as the brand name of Thunderon produced by TSUCHIYA TSCO COMPANY, Ltd., are held by the brush holder 41. By configuring like this, the charge transmitted to the charge eliminating brush 40 is transmitted to the drive plate 22, so the grounding can be positively done. Further, as the guide groove 26 is defined to a width that a human finger cannot intrude therein, i.e., equal to or smaller than 10 mm although not shown in the drawing, it will not happen that the operator or maintenance personnel touch the brush 40 with their fingers carelessly resulting in the breakage of the brush 40.

Corona discharge is a phenomenon that occurs when a needle-like electrode is opposed to a charged electrode and a voltage higher than a certain value is applied between the electrodes, in which a weak discharge current flows out from near the tip of the needle emanating pale light. The discharging can suppress the shock caused by the spark discharge of static electricity all at once like a thunderbolt by allowing the electricity to be relieved when handling, for example, an article containing electrically conductive fiber, etc. After the accumulated charge is corona-discharged, spark discharge does not occur or is very weak even if it occurs when an electrode is brought into contact with a conductive member. Therefore, when attaching or detaching the process unit 60 to or from the main body 20 of the image forming machine, spark discharge due to the accumulated charge can be prevented by bringing the conductive shaft 61 of the process unit 60 near to the charge eliminating brush 40 to allow the charge accumulated on the image carrier device (photoreceptor) 8 to be corona-discharged between the charge eliminating brush 40 and conductive shaft 61. Accordingly, the occurrence of the phenomenon that the execution of the initializing program in the CPU of the controller is impeded due to noise signals as mentioned before can be prevented.

Next, the operation of the image forming machine of the present invention will be explained with reference to FIG. 1. When an instruction signal to form an image is received from a controller not shown in the drawing, the image carrier device (photoreceptor) 8 is exposed to the light from an exposure device not shown in the drawing to have a latent image formed thereon, and the latent image is developed by means of a developing device not shown in the drawing to have a toner image formed thereon. On the other hand, a copy sheet 2 is picked up by the pick up roller 3 from the paper feeder cassette 1 accommodating copy sheets 2 therein to be transferred to the intermediate rollers 5 by means of the separation/feed rollers 4, and the sheet is further transferred to the registration rollers 7. The sheet is fed by the registration rollers 7 to the image transfer position in synchronization with the timing of toner image formation on the image carrier device (photoreceptor) 8, where the toner image on the photoreceptor 8 is transferred to the copy sheet 2 by means of the image transfer roller 9 applied with bias voltage. The copy sheet 2 onto which the toner image is transferred is transferred to the fusing rollers 10 to have the toner image permanently affixed thereto and then ejected by means of the ejecting rollers 11. The pick up roller 3 picks up a copy sheet 2 accommodated in the paper feeder cassette 1. The second sheet transfer roller 6 rotates when a copy sheet 2 placed on the manual feed path 14 is used to send the copy sheet 2 to the intermediate rollers 5. The pair of intermediate rollers 5 sends the copy sheet 2 transferred from the pick up roller 3 or from the second sheet transfer roller 6 to the pair of registration rollers 7. The pair of registration rollers 7 feeds the copy sheet 2 to the image carrier device (photoreceptor) 8 in synchronization with the timing that the leading edge of the toner image formed on the image carrier device 8 comes to the position of the image transfer roller 9.

In the main body 20 of the image forming machine according to the present invention composed as described above, when a copy sheet 2 is jammed during image formation in the state the copy sheet 2 is nipped between the image forming body (photoreceptor) 8 and image transfer roller 9 due to the occurrence of a malfunction in the clutch, inadequate feeding of a copy sheet 2 due to the skew of the sheet, slipping of the sheet, etc., as mentioned before, the image carrier device (photoreceptor) 8 is still charged, for the charging device 63 for charging the image carrier device (photoreceptor) 8 had been working until just before. If the user detaches the process unit 60 from the main body 20 of the image forming machine to remove the jammed copy sheet and again sets the process unit 60 to the main body 20 of the image forming machine, corona-discharging occurs between the electrically conductive shaft 61 of the image carrier device (photoreceptor) 8 and charge eliminating brush 40 peeping through the guide groove 26 when the process unit 60 is detached from and attached to the main body 20. Therefore, the electric charge accumulated on the image carrier device (photoreceptor) 8 is almost entirely discharged, and when the process unit 60 is replaced and the conductive shaft 61 of the process unit 60 contacts with the ground plate 30 as a contact member shown in FIG. 2(A), strong electrical discharge does not occur as does in a conventional image forming machine. Accordingly, the occurrence of malfunction of the initializing program in the main body 20 of the image forming machine due to noise can be evaded.

The charge eliminating brush 40 may be located so that it contacts with the conductive shaft 61 of the process unit 60, for in that case corona-discharging occurs when the conductive shaft 61 comes near to the charge eliminating brush 40 before the conductive shaft 61 contacts the brush 40 and the charge is decreased, and the residual charge is entirely discharged by the contact of both the conductive shaft 61 with the brush 40. Therefore, strong spark discharge between them as mentioned above can be prevented. However, when the charge eliminating brush 40 is composed of thin strings or threads of polycarbonate as mentioned before, it may happen that the thin strings or threads are loose, broken, or dropped out when the conductive shaft 61 comes into contact with the brush 40. If a part of the ears 42 of the brush 40 falls off and is conveyed by the air stream produced by a cooling fan in the machine onto the circuit board of an engine in the machine, a short circuit may be developed in the circuit board resulting in the malfunction of the circuit board of the engine. It is preferable to secure a clearance of for example about 1~2 mm, preferably about 1 mm between the tips of the brush ears 42 as shown in FIG. 5(A) and the conductive shaft 61 of the process unit 60 for preventing the occurrence of the malfunction of the circuit board due to deranged ears or broken and fallen ears of the charge eliminating brush 40. By using the charge eliminating brush 40 as charge eliminating means, a mould which is needed for making a leaf spring when the leaf spring is used as a charge eliminator, is not necessary to be prepared, which contributes to cost sparing.

Although in the forgoing explanation the charge eliminating brush 40 is used as a charge eliminating member for removing the electric charge accumulated on the image carrier device (photoreceptor) 8 of the process unit 60, the member of the second embodiment shaped like a leaf spring shown for example in FIG. 8(A) or the member of the third or fourth embodiment shaped like a leaf spring shown in FIG. 10 or FIG. 12(A) which can be attached to the drive plate 22 are suitable for a charge eliminating member.

Figure 9:
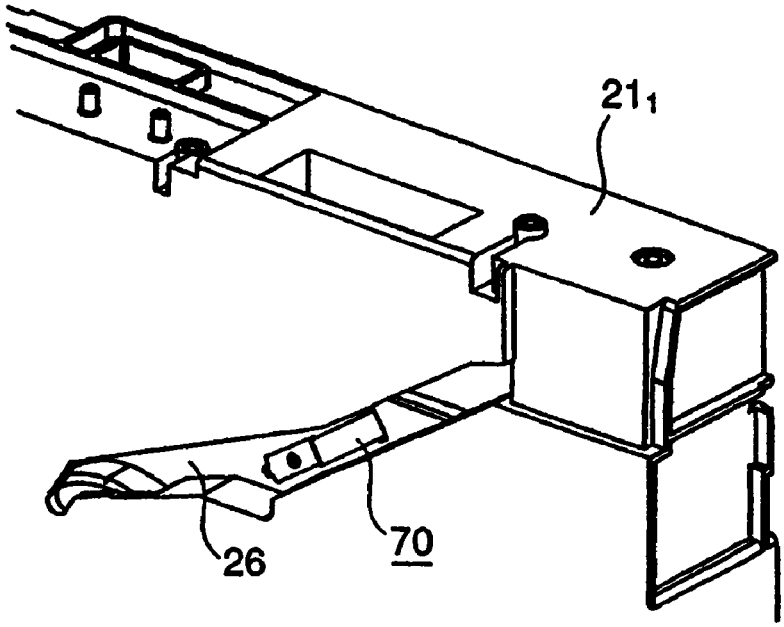
FIG. 9 is a perspective view showing the state the second embodiment of the charge eliminating member for allowing the electric charge accumulated on the image carrier device to be discharged is positioned near the right side guide groove.

The charge eliminating member (ground plate) 70 of leaf spring shape of the second embodiment shown in FIG. 8(A) has a crest part 72, a hole 73 for attaching the member to the drive plate 22 by means of a tightening vise, etc., an end part 71 for inserting in a slit or hole 75 provided in the drive plate 22, and a claw part 74 for inserting in a slit or hole 76 provided in the drive plate 22. The member 70 is attached to the drive plate 22 as shown in FIG. 8(B) by inserting the claw part 74 in the slit or hole 76, inserting the end part 71 in the slit or hole 75, and tightening the vise. When the drive plate 22 is attached to the base frame $\mathbf{21}_1$, the ground plate 70 protrudes in the guide groove 26 as shown in FIG. 9. When the process unit 60 is attached to or detached from the machine body 20, the conductive shaft 61 of the process unit 60 can smoothly pass over the crest part 72 of the ground plate 70 because the crest part 72 is pushed by the end face of the conductive shaft 61 to be receded by virtue of the plunging of part of the slope of the crest part 72 into the slit or hole 75 where the end part 71 of ground plate 70 is inserted. By the contact of the end face of the conductive shaft 61 with the crest part 72 of the ground plate 70, the accumulated electric charge is discharged from the conductive shaft 61 of the process unit 60.

The charge eliminating member 80 of the third embodiment shown in FIG. 10 is attached to the drive plate 22 as shown in FIG. 11. The side plate 81 is passed through a hole 85 provided in the drive plate 22 so that both the side plates 81 and 82 pinch the drive plate 22 and the protrusion 82 contacts the fringe of the drive plate 22. The charge eliminating member 80 is fixed to the drive plate 22 in this way. The crest part 84 protrudes in the guide groove 26 to be contacted with the end face of the conductive shaft 61 when the process unit 60 is detached or attached as is the case with the second embodiment shown in FIG. 9. The charge eliminating member 90 of the fourth embodiment shown in FIG. 12(A) is attached to the drive plate 22 as shown in FIG. 12(B). The part 91, 92, and 93 of the member 90 are inserted in an opening 96 provided in the drive plate 22. The part 91 and 92 stretch in the opening 96 by the resiliency of the part 91, and the part 93 is brought into close contact with the cut-and-erected part 97 of the drive plate 22 by the resiliency of the end part 94. The charge eliminating member 90 is fixed to the drive plate 22 in this way so that the crest part 95 protrudes in the guide groove 26 to be contacted with the end face of the conductive shaft 61 when the process unit 60 is detached or attached as is the case with the second embodiment shown in FIG. 9. By disposing the leaf spring like charge eliminating member 90 in the position remote from the wiring or circuit board as described above, the influence due to discharging can be eliminated, since the influence of noise as electromagnetic waves weakens inversely with the square of the distance. By the configuration of the ground plates of the second, third, and fourth embodiment, the end face of the conductive shaft 61 of the process unit 60 contacts with the ground plate when detaching/attaching the process unit 60 and the electric charge accumulated on the image carrier device (photoreceptor) 8 is discharged. Therefore, the occurrence of malfunction of the initializing program provided to the image forming machine body 20 can be evaded.

It is suitable that a gauze of thin metal strings sandwiching electrically conductive rubber for giving resiliency thereto is located so that the mesh contacts the conductive shaft 61 of the process unit 60. The corona-discharging capacity of the metal gauze is smaller than that of the charge eliminating brush 40, for the thin strings of the metal gauze are thicker than that of the charge eliminating brush 40 and not all of the tips of the thin strings are facing toward the conductive shaft 61. However, it is possible to compose the metal gauze to have corona-discharging capacity larger than that of the leaf spring. In the case of the metal gauze, also a contact type and non-contact type is possible, but as corona-discharging capacity of a non-contact type depends largely on the distance from the conductive shaft 61, a contact type is preferable.

The location of the contact member is not limited at the position shown in the embodiments, and an electrically conductive bearing, etc., supported by a resilient grounded member can be used as a charge eliminating member. It is also suitable to compose such that a bearing or a member like a bearing contacting the electrically conductive shaft 61 of the image carrier device 8 is provided in the process unit 60 and the bearing or the member like a bearing is connected with the grounding line provided in the process unit 60 to be connected to the grounding conductor of the image forming machine.

As has been described in the foregoing, according to the present invention, by providing a charge eliminating member to face the end face of the conductive shaft sliding along the guide groove through the guide groove, which allows the electric charge accumulated on the image carrier device in an image forming machine to be discharged when the process unit having at least the image carrier device is detached/attached, the charge accumulated on the image carrier device is removed by electric discharge between the conductive shaft of the image carrier shaft and the charge eliminating member at least two times, i.e., when detaching and attaching the process unit, and the amount of the charge decreased is larger. Therefore, even if discharge occurs by chance between the conductive shaft of the image carrier device and the contact member when detaching and then attaching the process unit, the noise due to the discharge is very weak. Accordingly, when the copy sheet is jammed in the process of image formation and the process unit is detached to remove the jammed sheet in the state the image carrier device is charged with electric charge, the occurrence that the execution of the initializing program in the CPU of the controller is interfered by the noise signal can be prevented.

By composing the charge eliminating member as a charge eliminating brush by bundling electrically conductive thin strings or threads of volume specific resistance of 1~0.01 Ω·cm, it is possible to effectively eliminate the electric charge remaining on the image carrier device by discharging.

By locating the charge eliminating member so that there is a certain clearance, for example 1~2 mm, between the tip of the bundled conductive thin strings or threads and the conductive shaft when the conductive shaft passes by the charge eliminating member in one of the guide grooves, the occurrence are prevented that the bundled conductive thin strings or threads are deranged, bent, or broken and the broken piece or pieces of the thin strings or threads fall in the image forming machine and are conveyed by the cooling air produced by the fan in the machine to the circuit board even if the unit or the image carrier device is detached or attached, for the conductive shaft of the image carrier shaft does not come into contact with the charge eliminating member. As a result, the occurrence of malfunction in the circuit board, etc., is prevented. As the discharging is done by corona-discharging, the discharging can be done even if there is a certain clearance between the tip of charge eliminating member and the conductive shaft, and the occurrence can be prevented that the execution of the initializing program in the CPU of the controller is interfered by the noise signal.

Further, by configuring the charge eliminating member such that its width is larger than the diameter of the conductive shaft and providing the charge eliminating member to the drive plate provided with the drive force transmission mechanism of the machine so that the brush faces the end face of the conductive shaft sliding along the guide groove through the guide groove of which the width is equal to or smaller than 10 mm, it is not necessary to prepare a special grounding means, and the cost of the image forming machine is reduced.

Further, it is suitable that the charge eliminating member is a leaf spring like member made of metal provided protruding in the groove so that the conductive shaft contacts the member when the unit is detached/attached by guiding the conductive shaft along the guide grooves.

While the invention has been described with reference to certain preferred embodiments thereof, it will be understood that modifications and variations are possible within the scope of the appended claims.

What is claimed is:

1. A discharge method for discharging a process unit that is detachable from an electrophotographic imaging apparatus and includes an image carrier device, comprising:

extracting said process unit from a prescribed location internal to said electrophotographic imaging apparatus to an extracted location external to said electrophotographic imaging apparatus, wherein said image carrier device of said process unit includes an electrically conductive shaft that supports the image carrier device and is guided by a groove as the process unit is extracted; and discharging said process unit through said electrically conductive shaft of said image carrier device and a charge eliminating member, when said process unit is extracted from said electrophotographic imaging apparatus.

2. The discharge method according to claim 1, wherein said charge eliminating member is a charge eliminating brush which faces an end surface of said electrically conductive shaft of said image carrier device at a prescribed distance.

3. The discharge method according to claim 1, wherein a width of said charge eliminating member is greater than a diameter of said electrically conductive shaft.

4. The discharge method according to claim 1, wherein said electrically conductive shaft contacts said charge eliminating member when said process unit is extracted from said electrophotographic imaging apparatus.

5. The discharge method according to claim 4, wherein said charge eliminating member is a charge eliminating brush which contacts said electrically conductive shaft of said image carrier device.

6. The discharge method according to claim 5, wherein said charge eliminating member is a bent metal spring plate whose bent portion contacts said electrically conductive shaft of said image carrier device.

7. The discharge method according to claim 5, wherein said charge eliminating member is a metal mesh.

8. The discharge method according to claim 1, further including inserting said process unit from a location external to said electrophotographic imaging apparatus to a location internal to said electrophotographic imaging apparatus; and discharging said process unit through said electrically conductive shaft of said image carrier device and said charge eliminating member, when said process unit is inserted into said electrophotographic imaging apparatus.

9. The discharge method according to claim 1, wherein a volume specific resistance of said charge eliminating member is at most 1 Ω·cm.

10. An image forming machine comprising:

a unit including, at least an image carrier device for forming a toner image by an electrophotographic method mounted detachably thereto, wherein the image carrier device includes an electrically conductive shaft that supports the image carrier device;

a contact member provided at a first position where the electrically conductive shaft of the unit comes into contact with the contact member when the unit is positioned in place; and a charge eliminating member, that eliminates electric charge accumulated on the image carrier device by way of the electrically conductive shaft, located at a second position upstream of the first position of the contact member;

wherein the image forming machine has guide grooves in a base frame thereof that guides end parts of the electrically conductive shaft of said image carrier device when the unit is positioned in place.

11. The image forming machine according to claim 10, wherein said charge eliminating member is a charge eliminating brush.

12. The image forming machine according to claim 11, wherein said charge eliminating brush is composed of electrically conductive thin strings or threads.

13. The image forming machine according to claim 12, wherein a certain clearance is provided between the tip of the thin strings or threads and the electrically conductive shaft when the electrically conductive shaft guided in the guide grooves passes by the thin strings or threads.

14. The image forming machine according to claim 10, wherein a volume specific resistance of said charge eliminating member is at most 1 Ω·cm.

15. The image forming machine according to claim 10, wherein said charge eliminating member is larger in width than the diameter of the electrically conductive shaft.

16. The image forming machine according to claim 10, wherein said charge eliminating member is protruded in the guide grooves so that the electrically conductive shaft contacts the charge eliminating member when the electrically conductive shaft is guided through the grooves.

17. An image forming machine comprising:

a unit including at least an image carrier device for forming a toner image by an electrophotographic method mounted detachably thereto, wherein the image carrier device includes an electrically conductive shaft that supports the image carrier device;

a base frame including guide grooves for guiding end parts of the electrically conductive shaft of said image carrier device in order to position the unit in place;

a charge eliminating member that protrudes into said guide grooves, wherein the charge eliminating member comprises a charge eliminating brush composed of electrically conductive thin strings or threads and attached to a drive plate to which a drive force transmission mechanism of the image forming machine is mounted;

wherein the charge eliminating brush is located so that a clearance of 1-2 mm is provided between tips of the conductive thin strings or threads and the electrically conductive shaft when the electrically conductive shaft is guided in the guide grooves and passes by the charge eliminating brush; and wherein the electrically conductive thin strings or threads are fibers coated with copper sulfide having a volume specific resistance of 1-0.01 Ω·cm.

* * * * *